US009267235B2

(12) United States Patent
Lippl

(10) Patent No.: US 9,267,235 B2
(45) Date of Patent: Feb. 23, 2016

(54) ROLL

(71) Applicant: VOITH PATENT GMBH, Heidenheim (DE)

(72) Inventor: Sarah Lippl, St. Margarethen (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/524,312

(22) Filed: Oct. 27, 2014

(65) Prior Publication Data

US 2015/0041093 A1 Feb. 12, 2015

Related U.S. Application Data

(63) Continuation of application No. PCT/EP2013/058512, filed on Apr. 24, 2013.

(30) Foreign Application Priority Data

Apr. 27, 2012 (DE) ..... 10 2012 207 059

(51) Int. Cl.
*D21F 3/10* (2006.01)
*D21F 3/08* (2006.01)

(52) U.S. Cl.
CPC . *D21F 3/105* (2013.01); *D21F 3/08* (2013.01)

(58) Field of Classification Search
USPC ..... 162/361
IPC ..... D21F 3/10,3/05, 3/08
See application file for complete search history.

(56) References Cited

U.S. PATENT DOCUMENTS

| | | | |
|---|---|---|---|
| 5,895,689 | A | 4/1999 | Gajewski |
| 5,895,806 | A | 4/1999 | Gajewski |
| 6,027,769 | A | 2/2000 | Gajewski et al. |
| 8,647,475 | B2 | 2/2014 | Turunen |

FOREIGN PATENT DOCUMENTS

| | | | |
|---|---|---|---|
| DE | 102007000505 | A1 | 4/2009 |
| EP | 0982079 | A2 | 3/2000 |
| EP | 2518212 | A1 | 10/2012 |
| WO | 9742246 | A1 | 11/1997 |
| WO | 2009103301 | A2 | 8/2009 |
| WO | 2011073534 | A1 | 6/2011 |

*Primary Examiner* — Mark Halpern
(74) *Attorney, Agent, or Firm* — Laurence A. Greenberg; Werner H. Stemer; Ralph E. Locher

(57) ABSTRACT

A roll for a press section of a machine for making and/or finishing a fibrous web, such as a paper, board, or tissue machine, includes a roll body or roll shell and, disposed on the roll body or roll shell, a roll covering which has at least one functional layer which is suitable for entering into contact with the fibrous web or with a paper machine fabric. The functional layer is formed of a polymer which is a mixture of at least one prepolymer, a curing agent, a crosslinking agent, and an additive. The additive is selected from the following: perfluoropolyethers, bifunctional perfluoropolyether, or mixtures thereof.

10 Claims, 1 Drawing Sheet

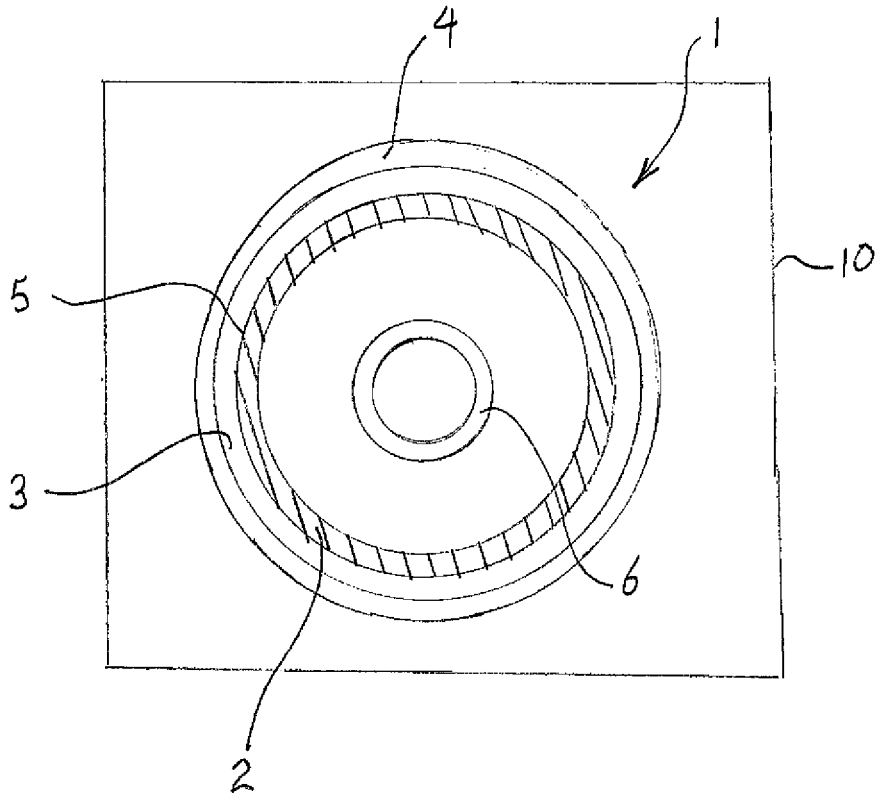
4
1
10
5
3
6
2

ROLL

CROSS-REFERENCE TO RELATED APPLICATION

This is a continuation, under 35 U.S.C. §120, of copending International Application No. PCT/EP2013/058512, filed Apr. 24, 2013, which designated the United States; this application also claims the priority, under 35 U.S.C. §119, of German Patent Application DE 10 2012 207 059.1, filed Apr. 27, 2012; the prior applications are herewith incorporated by reference in their entirety.

BACKGROUND OF THE INVENTION

Field of the Invention

The invention relates to a roll for a press section of a machine for making and/or finishing a fibrous web, such as a paper, board, or tissue machine. The roll includes a roll body or roll shell and a roll covering which is disposed on the roll body or roll shell and has at least one functional layer suitable for entering into contact with the fibrous web or with a paper machine fabric. The functional layer is formed of a polymer which is a mixture of at least one prepolymer, at least one curing agent and/or at least one crosslinking agent, and at least one additive.

In the press section of the aforementioned machines, it is common to use press rolls or suction press rolls which, following initial dewatering in the forming section, remove further liquid from the fibrous web by using, in particular, mechanical pressure and/or suction withdrawal.

The press rolls or suction press rolls used are often coated with polyurethane. The dewatering capacity of the press roll covering or suction press roll covering in that case is dependent primarily on the surface structure of the roll covering. Commonly present are patterns of blind holes and grooves, which provide an open volume into which the water pressed out from the fibrous web can escape.

In the case of suction press rolls, there are commonly additionally suction holes present as well, which pass through the roll shell. Water is drawn from the fibrous web through the suction holes by using, for example, a suction box located in an inside volume of the roll.

A press roll according to the prior art is known, for example, from International Publication No. WO2011/015386, corresponding to U.S. Pat. No. 8,496,785, where a combination of a press felt with a press roll covering and/or a suction roll covering is described for a paper machine. The press roll covering is provided with a circumferential groove surface structure, and the proportion of an open surface area within the total surface area of the press roll covering is in a range from 20% to 50%. Further described is a suction press roll which, in addition to the circumferential groove surface structure, is provided with a hole configuration featuring a plurality of suction holes which completely penetrate the suction roll covering. The proportion of an open surface area within the total surface area of the suction roll covering is in a range from 30% to 50%. Moreover, there may be additional hole configurations in the form of blind holes for both forms of rolls.

The shape, size, and configuration of the surface forms are critical contributors to the quality of the end product. The wrong choice of open area can lead to instability in the roll covering and also to hydraulic or mechanical marks.

A particular disadvantage of the press roll coverings and suction press roll coverings known from the prior art is that they are contaminated by long service, causing the surface forms to become clogged by fillers, fiber agglomerates, and resin impurities that are present in the fiber suspension, and to no longer be available as open volume for the dewatering of the paper web. Overall dewatering falls as a consequence. Furthermore, there may be unwanted fluctuations in the cross-sectional moisture profile as a result of nonuniform contamination.

As a remedy, mechanical cleaning devices yield inadequate results for the conditioning of roll coverings since, for example, scrapers and brushes are unable to clean the holes, while the treatment of the roll with wash solutions may lead to the entry of unwanted substances into the fibrous web and to the rewetting of the web.

International Publication No. WO97/42246 A1, corresponding to U.S. Pat. Nos. 5,895,806 and 5,895,689, European Patent Application EP 0 982 079 A2, corresponding to U.S. Pat. No. 6,027,769, International Publication No. WO2011/073534 A1, German Patent Application DE10 2007 000 505 A1, and International Publication No. WO2009/103301 A2, describe a roll for a paper machine that includes the above-mentioned features of the prior art.

SUMMARY OF THE INVENTION

It is accordingly an object of the invention to provide a roll, which overcomes the hereinafore-mentioned disadvantages of the heretofore-known rolls of this general type and which improves the known press roll coverings or suction press roll coverings in such a way that the disadvantages identified above can be avoided.

With the foregoing and other objects in view there is provided, in accordance with the invention, a roll for a press section of a machine for making and/or finishing a fibrous web, such as a paper, board, or tissue machine. The roll comprises a roll body or roll shell and a roll covering which is disposed on the roll body or roll shell and has at least one functional layer suitable for entering into contact with the fibrous web or with a paper machine fabric. The functional layer is formed of a polymer which is a mixture of at least one prepolymer, at least one curing agent and/or at least one crosslinking agent, and at least one additive. The additive is selected from the following group: perfluoropolyether, bifunctional perfluoropolyether and mixtures thereof.

The present invention provides for the functional layer to be formed of a polymer which is a mixture of at least one prepolymer, at least one curing agent and/or at least one crosslinking agent, and at least one additive. The polymer that forms the roll covering is therefore admixed with an additive which lowers the surface energy of the roll covering, meaning that water and dirt do not remain adhering to the surface of the roll covering and within the surface forms, but are instead rapidly transported away. This results in greater dewatering efficiency of the press roll and hence also of the paper machine. Fluctuations in the cross-sectional moisture profile can be avoided or at least reduced, thereby raising the quality of the end product.

Surprisingly, it has been determined that the hydrolysis resistance, the chemical resistance, and the mechanical properties of the functional layer of the invention are improved significantly by the polymer described.

The additive may preferably be selected from the following: perfluoropolyether, polytetrafluoroethylene, polyethylene, bifunctional perfluoropolyethers, or mixtures thereof. According to the invention, however, the additive is selected from perfluoropolyether, bifunctional perfluoropolyether, or mixtures thereof.

In accordance with another feature of the invention, the level at which the additive is admixed is preferably between 1 and 20 weight %. The greater the amount of additive, the greater the extent to which the surface energy can be lowered.

In accordance with another feature of the invention, the prepolymer may advantageously be a mixture of a polyol and a diisocyanate.

In accordance with a further feature of the invention, the polyol may preferably be selected from the following: polyethers, polyesters, polycarbonates, polycaprolactones.

In accordance with an added feature of the invention, the diisocyanate may be an aromatic or an aliphatic diisocyanate, or a mixture thereof.

In accordance with an additional feature of the invention, the aromatic diisocyanate may be selected from the following: diphenylmethane diisocyanate, toluene diisocyanate, or a mixture thereof. The aliphatic diisocyanate may be hexamethylene diisocyanate.

In accordance with yet another advantageous feature of the invention, the curing agent and/or the crosslinking agent may be a diamine, a diol, or a mixture thereof.

In accordance with a concomitant feature of the invention, the curing agent and/or the crosslinking agent may preferably be selected from 4,4'-methylenebis(3-chloro-2,6-diethylaniline) (MCDEA), 4,4'-methylenebis(2-chloroaniline) (MOCA), 1,4-butanediol, 1,3-propanediol, 1,2-ethanediol, trimethylolpropane, or mixtures thereof.

Other features which are considered as characteristic for the invention are set forth in the appended claims.

Although the invention is illustrated and described herein as embodied in a roll, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE SINGLE VIEW OF THE DRAWING

The FIGURE of the drawing is a diagrammatic, cross-sectional view of a roll in a press section of a machine for making and/or finishing a fibrous web.

DETAILED DESCRIPTION OF THE INVENTION

Referring now in detail to the single FIGURE of the drawing for explaining the invention in more detail, there is seen a press section 10 of a machine for making and/or finishing a fibrous web, including a paper, board, or tissue machine.

There is no need at this point for a comprehensive description of the construction of the roll, since press rolls and suction press rolls are known to a person of skill in the art. Generally speaking, such rolls 1 commonly have a roll core, roll body or roll shell 2 made from a metal such as steel or else from a fiber composite, which is provided with a single-layer or multilayer roll covering 3. This covering has an outermost layer 4 which is also termed the functional layer and for which the measures according to the invention are applicable. The join between the roll core 2 and the roll covering 3 is commonly produced by a so-called base layer or adhesion-promoting layer 5. There may be further, intermediate layers between this layer and the functional layer 4.

Where the press roll 1 acts as a suction system, a stationary suction box 6 may additionally and conventionally be present within the interior of the roll, around which the roll shell rotates.

The invention is suitable for application to press rolls and suction press rolls with roll coverings having a functional layer of customary hardness and customary surface roughness, of the kind typically used in paper, board, or tissue machines.

The functional layer of the press roll or suction press roll may be produced, as a person skilled in the art is aware, by using, for example, a rotomolding technique, with polymer being applied from a nozzle able to travel along the lengthwise axis of the roll core or roll shell to be coated, and with the roll core or shell being rotated at a uniform rate. After curing has taken place, the desired surface structures are applied, such as grooves, blind holes, suction holes, or combinations thereof, and the desired surface roughness of around 0.2 to 7.2 Ra is brought about by abrasion.

As the polymer for the functional layer of the roll covering, the invention uses a polyurethane which is in the form of a mixture and is formed of a prepolymer, a curing agent and/or a crosslinking agent, with an additive being added for modification.

The prepolymer in this case is prepared from a polyol such as, for example, polyether, polyester, polycarbonate, or polycaprolactone, and from a curing agent such as an aromatic or aliphatic diisocyanate. A suitable aromatic curing agent is, for example, diphenylmethane diisocyanate or toluene diisocyanate, whereas an appropriate aliphatic curing agent is, for example, hexamethylene diisocyanate.

Suitable chain extenders and/or chain crosslinkers include diamines such as 4,4'-methylenebis(3-chloro-2,6-diethylaniline) (MCDEA) or 4,4'-methylenebis(2-chloroaniline) (MOCA) and also short-chain diols such as 1,4-butanediol, 1,2-ethanediol, and 1,3-propanediol, or trifunctional products such as trimethylolpropane.

Suitable additives for the modification of the polyurethane encompass diverse classes of compound in various aggregate states such as, for example, perfluoropolyethers (trade name, e.g., Polysec c, liquid), polytetrafluoroethylene (PTFE; trade name, e.g., Osixo, powder), polyethylene (trade name, e.g., Inhance UH-1250, particulate), or bifunctional perfluoropolyether (trade name, e.g., Fluorolink, liquid). In accordance with the invention, however, the additive is selected from perfluoropolyether, bifunctional perfluoropolyether, or mixtures thereof.

Of these additives, 1 to 20 weight % can be added in order to obtain modification of the polyurethane in the desired way. Since the surface energy falls as the amount of additive goes up, an additive level as high as possible is desirable. A limit is imposed only by the costs of the additive, which from experience are very high.

In addition to the lowering of the surface energy and to the resultant reduction in dirt and water adhesion, it has also been possible, surprisingly, to observe an improved hydrolysis resistance and chemical resistance and also an improvement in the mechanical properties on roll coverings realized in accordance with the invention.

The invention claimed is:

1. A roll for a press section of a machine for making and/or finishing a fibrous web, including a paper, board, or tissue machine, the roll comprising:

a roll body or roll shell;

a roll covering disposed on said roll body or roll shell, said roll covering having at least one functional layer suitable for entering into contact with the fibrous web or with a paper machine fabric;

said functional layer being formed of a polymer being a mixture of at least one of at least one prepolymer, at least one curing agent or at least one crosslinking agent, and at least one additive; and said at least one additive being selected from the group consisting of perfluoropolyether, bifunctional perfluoropolyether and mixtures of perfluoropolyether and bifunctional perfluoropolyether.

2. The roll according to claim 1, wherein an amount of said at least one additive being added is 1 to 20 weight %.

3. The roll according to claim 1, wherein said prepolymer is a mixture of a polyol and a diisocyanate.

4. The roll according to claim 3, wherein said polyol is selected from the group consisting of polyethers, polyesters, polycarbonates and polycaprolactones.

5. The roll according to claim 4, wherein said diisocyanate is an aromatic or an aliphatic diisocyanate or a mixture of an aromatic and an aliphatic diisocyanate.

6. The roll according to claim 5, wherein said aromatic diisocyanate is selected from the group consisting of diphenylmethane diisocyanate, toluene diisocyanate or a mixture of diphenylmethane diisocyanate and toluene diisocyanate, and said aliphatic diisocyanate is hexamethylene diisocyanate.

7. The roll according to claim 3, wherein said diisocyanate is an aromatic or an aliphatic diisocyanate or a mixture of an aromatic and an aliphatic diisocyanate.

8. The roll according to claim 7, wherein said aromatic diisocyanate is selected from the group consisting of diphenylmethane diisocyanate, toluene diisocyanate or a mixture of diphenylmethane diisocyanate and toluene diisocyanate, and said aliphatic diisocyanate is hexamethylene diisocyanate.

9. The roll according to claim 8, wherein at least one of said curing agent or said crosslinking agent is selected from the group consisting of 4,4'-methylenebis(3-chloro-2,6-diethylaniline) (MCDEA), 4,4'-methylenebis(2-chloroaniline) (MOCA), 1,4-butanediol, 1,3-propanediol, 1,2-ethanediol, trimethylolpropane and mixtures of 4,4'-methylenebis(3-chloro-2,6-diethylaniline) (MCDEA), 4,4'-methylenebis(2-chloroaniline) (MOCA), 1,4-butanediol, 1,3-propanediol and 1,2-ethanediol, trimethylolpropane.

10. The roll according to claim 1, wherein at least one of said curing agent or said crosslinking agent is a diamine, a diol or a mixture of a diamine and a diol.

* * * * *